United States Patent [19]

de Francisco Mesado

[11] 4,229,141

[45] Oct. 21, 1980

[54] DEVICES FOR OPERATING VARIABLE-PITCH PROPELLERS

[76] Inventor: José Luis de Francisco Mesado, Po Cordelles, 6 F, 40 3a, Barcelona (Sardanyola), Spain

[21] Appl. No.: 895,106

[22] Filed: Apr. 10, 1978

[30] Foreign Application Priority Data

Apr. 6, 1977 [ES] Spain ..... 458.039

[51] Int. Cl.[2] ..... B63H 1/06

[52] U.S. Cl. ..... 416/157 R

[58] Field of Search ..... 115/34 R; 416/156, 157 R, 416/158

[56] References Cited

U.S. PATENT DOCUMENTS

| | | | |
|---|---|---|---|
| 3,232,350 | 2/1966 | Lorenz | 416/157 |
| 3,253,659 | 5/1966 | Seman | 416/158 X |
| 3,600,102 | 8/1971 | Dirlik | 416/156 X |
| 3,663,119 | 5/1972 | Brooking et al. | 416/158 X |
| 3,746,466 | 7/1973 | Dallach et al. | 416/157 X |

*Primary Examiner*—Sherman D. Basinger

*Attorney, Agent, or Firm*—Wenderoth, Lind & Ponack

[57] ABSTRACT

A propeller includes a hub having mounted on the central end part thereof a rotating fitting which permits the passage therethrough of a fluid circulating within two conduits which pass longitudinally of the fitting. The fluid operates on opposite ends of an annular piston to impart thereto rectilinear movement, which in turn is transformed into rotation of the blades of the propeller due to lugs extending from the piston and being eccentrically engaged with the blades. The hub of the propeller is completely free to turn without affecting the driving shaft. The assembly is positioned completely outside the stern of the ship.

1 Claim, 1 Drawing Figure

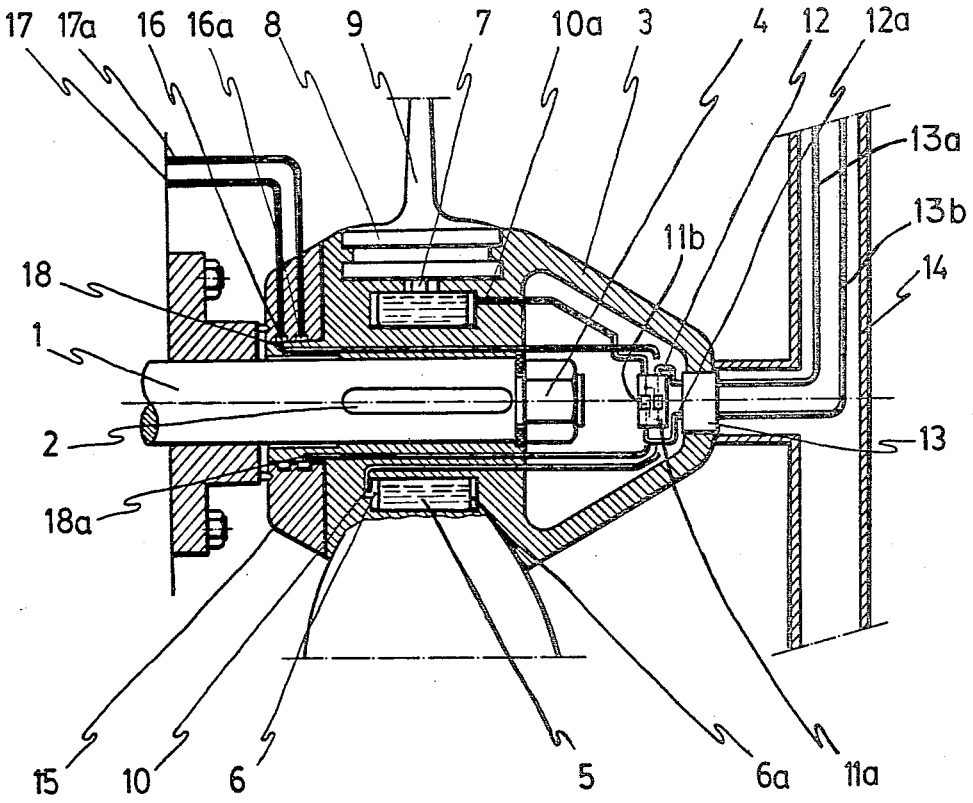
17
17a
16
16a
8
9
7
10a
3
4
12
12a
13a
13b
14
11b
18
1
2
13
18a
15
10
6
5
6a
11a

DEVICES FOR OPERATING VARIABLE-PITCH PROPELLERS

BACKGROUND OF THE INVENTION

As is known, greater or lesser speeds of a ship are obtained by increasing or decreasing the rotative speed of the engine, that is the number of revolutions at which the propeller turns per unit of time.

It will be understood that, due to the fact that the driving torque is reduced as the rotative speed of the engine is reduced, certain rotative speeds cannot be utilized.

The design of the propeller of a ship is directly related to the engine, depending on the power and rotative speed thereof.

When the ship is to convey a particular cargo at a particular speed, the propeller and the engine are designed according to these needs. However, when the ship must use the complete power of its engine at speeds differing from the predetermined speed, a suitable response is not obtained due to the lack of adaptability of the propeller in view of this contingency.

The existence of variable-pitch propellers has put an end to such problem. In short, a variable-pitch propeller consists of a propeller having blades the pitch of which can be oriented without having to stop the ship.

In view of this innovation, an optimum driving torque is obtained at different engine speeds.

One of the most suitable applications of the variable-pitch propeller is its use in hauler fishing vessels which, due to their characteristics, have a sailing speed and another speed, which could be referred to as a working speed, for hauling the net during fishing.

In the first case, the ship should sail with an optimum driving torque which permits a rapid and economical speed.

In the second case, the speed is slower but the power needed is higher, due to the additional load resulting from the weight of fish being hauled or carried.

The variation in the draft of the blades of the propeller is the best solution and as such it was put into practice immediately by shipbuilders, so that newly constructed ships incorporate variable-pitch propellers.

The use of such propellers calls for the ship to already be designed therefore, since it is necessary to adapt the transmission shafts so that the necessary mechanisms which act on the blades to orient their draft are arranged therein.

Ships which have already been constructed must be modified so that variable-pitch propellers can be adapted thereto. However, the necessary modifying operations to be carried out affect the internal structure of the ship, they require a prolonged time in the shipyard, and the cost is high. For these reasons shipbuilders are unwilling to make such adaptations.

It is, therefore, desirable to find a solution which permits already existing ships incorporating a propeller having fixed blades to be transformed into ships incorporating a propeller having variable-pitch blades. However, this transformation should not affect the structure of the ship too greatly, to thereby reduce the expenses resulting from the inactivity of the ship and from the adaptation.

SUMMARY OF THE INVENTION

The object of this invention is to provide improvements in devices for operating the blades of variable-pitch propellers, the adaptation to which does not require the handling of the internal transmission system, and, consequently, whereby all the operations of adaptation are carried out outside the hull of the ship, with the consequent advantages to a shipbuilder in order to modify already existing ships provided with fixed pitch propellers.

The improvements of this invention mainly consist in arranging in the interior of the hub of the propeller a double effect annular piston which is eccentrically, by means of lugs, joined to rotating bases which are embedded and guided in the hub and which support the blades of the propeller.

The double effect piston is activated hydraulically from the interior of the ship, and guided double-acting no-return valves, which facilitate handling, are placed between those elements which give the necessary pressure to displace the annular piston and the annular piston itself.

Pressure fluid is introduced against either of opposite end faces of the piston, so that the same is linearly displaced. This movement is transformed, due to the eccentric connection between the lugs and the blade bases, into simultaneous rotational movement of all the bases of the blades, thereby varying their orientation to another and different pitch which modifies the advance of the propeller.

The manner in which the hydraulic fluid is led to the annular piston furthermore constitutes an important feature of the invention, since the assembly is included in the hub and it therefore turns therewith.

The present invention provides two alternative mechanical solutions. The first solution consists in mounting on the hub of the propeller, at the end central portion thereof, a rotating fitting which permits, through a fixed core thereof, the inflow and outflow of a fluid circulating within two ducts which cross the fitting longitudinally, the hub of the propeller being completely free to turn.

All this takes place without affecting in the least the integrity of the driving shaft, and with the assembly remaining completely outside the stern of the ship.

The second solution does not in any way modify the essential features of the invention and consists in causing the fluid to reach the no-return valves through a collar fixed and adjusted to the hub, which collar is provided with grooves into which the fluid ducts open.

The interior of the collar is fitted in a recess in the hub. Ducts are connected to the grooves and extend longitudinally through the hub to be joined to the guided double no-return valves.

It is also possible to withdraw from the interior of the hub the guided double no-return valves and to place them next to the collar, so that the ducts made in the hub could be directed directly to the respective fronts of the annular piston.

In any of the above solutions, the main feature of the invention is to move the annular piston at will and without having to stop the ship, thereby varying the pitch of the blades of the propeller according to the required needs.

BRIEF DESCRIPTION OF THE DRAWING

The single FIGURE of the attached drawing is a longitudinal sectional schematic figure which illustrates the improvements of the invention.

DETAILED DESCRIPTION OF THE INVENTION

The FIGURE shows an annular piston arranged in a chamber into which communicate ducts through which fluid passes to and from guided double no-return or one-way valves.

At the inlet of the no-return valves are provided feeding conduits. Adjacent the feeding conduits are unconnected ducts which may be employed in a second application and which extend from grooves provided in a fixed collar arranged about a recess or reduced size portion formed in the hub. It is thus clear that, although there are two alternatives for introducing the fluid, the principle of the invention is basically the same in either case.

The various reference numerals shown in the FIGURE correspond to the following parts:

1. Shaft of the propeller;
2. Locking key for locking the shaft 1 to the hub 3;
3. Hub of the propeller;
4. Locking nut attaching the hub 3 to the shaft 1;
5. Annular piston;

6 and 6*a*. Varying volume chambers formed at opposite ends of the piston 5;

7. Lugs by means of which the annular piston 5 is joined to the bases 8 of propeller blades 9 and which transform rectilinear movement of the annular piston 5 into rotational movement of the bases 8 of the blades 9;
8. Bases of the blades;
9. Blades;

10 and 10*a*. Fluid inlet ducts to chambers 6 and 6*a*;

11*a* and 11*b*. Guided double-acting no-return valves;

12 and 12*a*. Feeding conduits for the guided double-acting no-return valves, coming from a rotating fitting;

13. Core of the rotating fitting;

13*a* and 13*b*. Stationary supply ducts supplying fluid to core 13 and then to conduits 12 and 12*a*;

14. Sleeve which is solidly fastened to the stern-post of the ship and which constitutes a protecting shell for the ducts 13*a* and 13*b*;
15. Collar fixed to the ship;

16 and 16*a*. Grooves in collar 15 and facing the recess of the hub 3;

17 and 17*a*. Feeding conduits extending to the grooves 16 and 16*a*; and

18 and 18*a*. Ducts which extend longitudinally through the hub 3 and which, according to the second embodiment, are joined to the feeding inlets of the guided double no-return valves.

By means of conventional valve elements, fluid is made to pass under pressure from a hydraulic power station situated in the ship through the duct 13*a* and core 13 into feeding conduit 12. The pressure fluid opens the guided double-acting no-return valve 11*a* and then passes through duct 10 and into the chamber 6, thus displacing the annular piston 5 rightwardly as shown in the FIGURE.

The guided double-acting no-return valve 11*a* simultaneously opens its twin valve 11*b* and opens a path therethrough, so that the fluid displaced by the annular piston 5 is discharged from the chamber 6*a* and passes through duct 10*a*, valve 11*b*, conduit 12*a*, core 13, and duct 13*b* into the tank of the hydraulic power station.

Upon the above described linear displacement of the annular piston 5, rotation of the blades 9 takes place due to the eccentric connection of the lugs 7 with their respective bases 8.

When the action of the hydraulic fluid ceases, the guide double-acting no-return valves are closed, and the blades of the propeller are locked in the position reached without possibility of being varied, unless they are again hydraulically activated.

By supplying fluid through duct 13*b*, core 13 and feeding conduit 12*a*, the blades will be rotated in a direction opposite to that described above.

When the second embodiment of the invention is employed, the ducts 18 and 18*a* will be connected to the guided double-acting no-return valves. Thus, a circuit different from that described above is formed.

When hydraulic fluid passes through one of the conduits 17 or 17*a*, supplied from the hydraulic power station on the ship, the blades are rotated in the same manner as previously described.

Thus, for example, if the fluid is supplied through the conduit 17, it then reaches the groove 16 and passes through the duct 18 and opens the valve 11*a*, from where, through duct 10, it penetrates into the chamber 6 and moves piston 5 rightwardly as shown in the FIGURE.

The activation of the annular piston, and therefore the variation in the pitch of the blades, is achieved with the same ease and precision using either of the above two described fluid supply circuits. It should only be taken into account that according to the second solution the collar 15 which is provided with the grooves 16 and 16*a* must be fitted about the hub in a manner to withstand the fluid pressure necessary to move the blades.

The rotating fitting 13 is applicable to any type of propeller.

I claim:

1. A variable pitch propeller comprising:

a rotatable propeller shaft;

a propeller hub positioned around and fixed to said propeller shaft and adapted to rotate therewith;

a plurality of propeller blades spaced around said hub, each said blade having a base mounted within said hub for rotation about the axis of said base, whereby rotation of said bases around said axes will vary the pitch of said blades;

an annular cylindrical piston slidably mounted within said hub for rectilinear movement in opposite directions parallel to and coaxial with said propeller shaft;

first and second pressure fluid chambers within said hub at opposite ends of said piston;

a plurality of lugs and extending outwardly from said piston, each said lug engaging a respective said base eccentrically of said axis thereof, whereby rectilinear movement of said piston is transformed into rotation of said bases about said axes;

a double-acting valve unit positioned within said hub for rotation therewith, said unit including first and second double-acting valves, said valves being ganged so that movement of either of said valves causes movement of the other of said valves;

a first fluid duct connecting said first pressure fluid chamber to said first valve;

a second fluid duct connecting said second pressure fluid chamber to said second valve;

first feed conduit means for supplying pressure fluid from a supply to said first valve, and for thereby opening said first valve in a first valving direction;

second feed conduit means for supplying pressure fluid from the supply to said second valve, and for thereby opening said second valve in a second valving direction;

whereby when said first feed conduit means supplies pressure fluid to said first valve and opens said first valve in said first valving direction, said pressure fluid is caused to pass through said first fluid duct into said first pressure fluid chamber and to move said piston in a first rectilinear direction, thereby causing rotation of said bases and blades in a first rotative direction, said opening of said first valve in said first valving direction causing opening of said second valve in said first valving direction, thereby allowing pressure fluid to pass from said second pressure fluid chamber, through said second fluid duct, said second valve and said second feed conduit means, to thereby be returned to the supply; and whereby when said second feed conduit means supplies pressure fluid to said second valve and opens said second valve in said second valving direction, said pressure fluid is caused to pass through said second fluid duct into said second pressure fluid chamber and to move said piston in a second rectilinear direction, thereby causing rotation of said bases and blades in a second rotative direction, said opening of said second valve in said second valving direction causing opening of said first valve in said second valving direction, thereby allowing pressure fluid to pass from said first pressure fluid chamber, through said first fluid duct, said first valve and said first feed conduit means, to thereby be returned to the supply.

* * * * *